US007630678B2

(12) United States Patent
Kishi et al.

(10) Patent No.: US 7,630,678 B2
(45) Date of Patent: Dec. 8, 2009

(54) PROCESS CARTRIDGE AND IMAGE FORMING APPARATUS

(75) Inventors: Yousuke Kishi, Suntoh-gun (JP); Ryosuke Kanai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 11/850,305

(22) Filed: Sep. 5, 2007

(65) Prior Publication Data

US 2009/0041518 A1 Feb. 12, 2009

(30) Foreign Application Priority Data

Aug. 10, 2007 (JP) ..... 2007-208738

(51) Int. Cl.
*G03G 21/00* (2006.01)

(52) U.S. Cl. ..... 399/350; 399/343; 399/111

(58) Field of Classification Search ..... 399/343, 399/111; 15/1.51, 256.5, 256.51, 256.52
See application file for complete search history.

(56) References Cited

U.S. PATENT DOCUMENTS 7,050,741 B2 * 5/2006 Koike et al.
7,421,226 B2 * 9/2008 Suenami et al. ..... 399/104
2004/0240915 A1 * 12/2004 Nakayama
2009/0041519 A1 * 2/2009 Uchida et al. ..... 399/350

FOREIGN PATENT DOCUMENTS

JP 2001-75451 3/2001
JP 2002-162885 6/2002
JP 2003-122222 4/2003

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

A process cartridge is detachably mountable to an image forming apparatus. The process cartridge includes an image bearing member, a developing member for developing an electrostatic latent image formed on a surface of the image bearing member and a cleaning member having a blade contacted to the image bearing member along a longitudinal direction of the image bearing member to remove the developer from the surface of the image bearing member. The cleaning member has a processed portion containing an isocyanate compound at each of longitudinal end portions of the blade, wherein a longitudinally inside end of the processed portion is disposed longitudinally inside a developer carryable region of the developing member which is capable of carrying the developer.

6 Claims, 5 Drawing Sheets

PROCESS CARTRIDGE AND IMAGE FORMING APPARATUS

FIELD OF THE INVENTION AND RELATED ART

The present invention relates to an image forming apparatus and a process cartridge, which employ a cleaning member.

An image forming apparatus repeats the process of forming a toner image on its photosensitive drum(s), and transferring the toner image from the photosensitive drum onto a recording medium. Thus, it is necessary to remove the toner (developer) remaining on the photosensitive drum, that is, the toner which failed to be transferred onto the recording medium. As the cleaning means for removing the toner remaining on the photosensitive drum after the image transfer from the photosensitive drum, there are a fur brush, a blade, etc. However, for cost and performance, a cleaning blade formed of polyurethane rubber is the mainstream choice. A cleaning blade is positioned so that its cleaning edge is pressed upon the peripheral surface of a photosensitive drum. Ordinarily, it is tilted so that its cleaning edge is on the upstream side relative to its base in terms of the rotational direction of the photosensitive drum.

However, placing a cleaning blade tilted so that its cleaning edge is on the upstream side relative to its base in terms of the rotational direction of the photosensitive drum makes the friction between the photosensitive drum and cleaning blade greater than placing the cleaning blade tilted in the other direction, making it likely for the edge portion of the cleaning blade to buckle into the interface between the peripheral surface of the photosensitive drum and the cleaning blade.

In terms of the direction parallel to the axial direction of a photosensitive drum, the area of the peripheral surface of a photosensitive drum, across which toner is ordinarily adhered, is the portion of the peripheral surface of the photosensitive drum, which is in the image formation range. In the development process, however, a small amount of toner scatters, and a small portion of the toner having scattered sometimes adheres to the portion of the peripheral surface of the photosensitive drum, which is outside the abovementioned image formation range. As one of the means for minimizing the amount of the abovementioned stray toner particles that adheres to the portions of the peripheral surface of the photosensitive drum that are outside the image formation range, it is possible to charge the portions of the peripheral surface of the photosensitive drum that are outside the image formation range, as far outward as possible, in terms of the lengthwise direction of the photosensitive drum, in order to make it more difficult for the toner to adhere to the portions of the peripheral surface of the photosensitive drum that are outside the image formation range. That is, an arrangement is made to make it difficult for the portions of the photosensitive drum that are outside the image forming range, to electrostatically adhere toner thereto. However, even the employment of this type of means cannot completely prevent this problematic toner adhesion. Therefore, it is necessary to employ a cleaning blade, which is wide enough, in terms of the lengthwise direction of the photosensitive drum, to clean the portions of the peripheral surface of the photosensitive drum that are outside the image formation range, as well as the portion of the photosensitive drum that is in the image formation range.

On the other hand, in terms of the amount of toner and/or external additives that reaches a cleaning blade, the portions of the peripheral surface of the photosensitive drum that are outside the image formation range, are smaller than the portion of the peripheral surface of the photosensitive drum that is inside the image formation range. Incidentally, toner and external additives also function as the lubricant between the cleaning blade and photosensitive drum. Thus, the portions of the cleaning edge of a cleaning blade that are outside the image formation range, and therefore, contact a smaller amount of the stray toner and external additives which function as lubricant, are more likely to be buckled into the interface between the cleaning bade and a photosensitive drum.

According to the prior art, as the means for minimizing this type of bucking of the cleaning edge of a cleaning blade, it is possible to employ a cleaning blade, the cleaning edge portion of which is impregnated with isocyanate compound across its entire range in terms of its lengthwise direction (Japanese Laid open Patent Applications 2001-75451 and 2003-122222), or a cleaning blade, the cleaning edge portion of which is coated with resin film across its lengthwise end portions (Japanese Laid open Patent Application 2002-162885), for example.

However, as a cleaning blade formed of urethane resin is impregnated with isocyanate compound, the cleaning blade swells, and therefore, the cleaning edge portion of the cleaning blade becomes wavy, being therefore likely to allowing toner and/or external additive to slip by the cleaning blade.

On the other hand, coating a cleaning blade with resin film across its lengthwise end portions creates a step between the coated and uncoated portions of the cleaning blade, being therefore likely to allow toner to slip by the cleaning blade.

SUMMARY OF THE INVENTION

The primary object of the present invention is to provide an image forming apparatus and a process cartridge, which employ a cleaning member, the cleaning edge of which does not buckle, and remains satisfactory in terms of cleaning performance for a significantly greater length of time than a cleaning member in accordance with the prior art.

According to an aspect of the present invention, there is provided a process cartridge detachably mountable to an image forming apparatus, the process cartridge comprising an image bearing member; a developing member for developing an electrostatic latent image formed on a surface of the image bearing member; and a cleaning member having a blade contacted to the image bearing member along a longitudinal direction of the image bearing member to remove the developer from the surface of the image bearing member, the cleaning member having a processed portion containing an isocyanate compound at each of longitudinal end portions of the blade, wherein a longitudinally inside end of the processed portion is disposed longitudinally inside a developer carryable region of the developing member which is capable of carrying the developer.

According to another aspect of the present invention, there is provided an image forming apparatus for forming an image on a recording material, the image forming apparatus comprising an image bearing member; a developing member for developing an electrostatic latent image formed on a surface of the image bearing member; and a cleaning member having a blade contacted to the image bearing member along a longitudinal direction of the image bearing member to remove the developer from the surface of the image bearing member, the cleaning member having a processed portion containing an isocyanate compound at each of longitudinal end portions of the blade, wherein a longitudinally inside end of the processed portion is disposed longitudinally inside a developer carryable region of the developing member which is capable of carrying the developer.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

General Structure and Operation of Image Forming Apparatus

Figure 2:
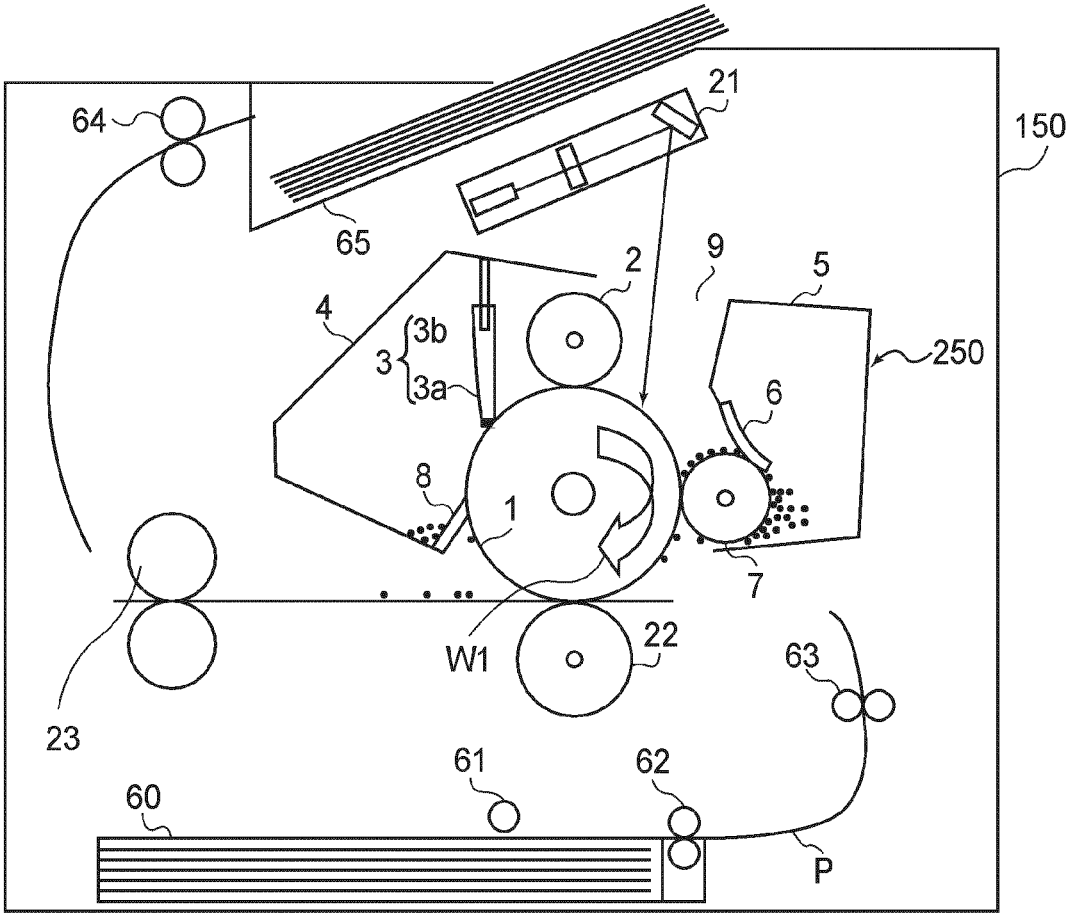
FIG. 2 is a schematic sectional view of an image forming apparatus, showing the structure of the apparatus.

FIG. 2 is a schematic sectional view of the image forming apparatus in one of the preferred embodiments of the present invention, and shows the general structure of the apparatus. The image forming apparatus 150 in this embodiment is a laser printer in which a process cartridge 250 is removably mountable.

Designated by a reference numeral 1 is a rotatable electrophotographic photosensitive member as an image bearing member, which is in the form of a drum. The photosensitive drum 1 is an organic photosensitive member, which is negatively chargeable. It is rotated by a motor (unshown) in the direction indicated by an arrow mark W1 at a preset peripheral velocity.

While the photosensitive drum 1 is rotated, it is uniformly and negatively charged to a preset potential level by a charge roller 2, which is rotated by the rotation of the photosensitive drum 1. To the charge roller 2, a bias voltage is applied from a charge bias application power source (unshown), to uniformly charge the peripheral surface of the photosensitive drum 1.

After being charged, the peripheral surface of the photosensitive drum 1 is exposed by an exposing apparatus 21, which is an apparatus for forming an electrophotographic latent image on the charged peripheral surface of the photosensitive drum 1. In this embodiment, a semiconductor laser scanner is employed as the exposing apparatus. The exposing apparatus 21 emits a beam of laser light while modulating the beam of laser light with picture signals sent from a host apparatus (unshown) in the image forming apparatus 150, so that the uniformly charged peripheral surface of the photosensitive drum 1 is scanned (exposed) by the beam of laser light projected upon the uniformly charged peripheral surface of the photosensitive drum 1, through the exposure window 9 of the process cartridge 250 which will be described later. As the uniformly charged surface of the photosensitive drum 1 is exposed by the beam of laser light emitted while being modulated with the picture signals, the numerous exposed points of the uniformly charged portion of the peripheral surface of the photosensitive drum 1 become lower in potential level in terms of absolute value than the unexposed points of the uniformly charged portion of the peripheral surface of the photosensitive drum 1, effecting thereby an electrostatic latent image, which reflects the picture signals.

Then, the electrostatic latent image is developed into a visible image, that is, an image formed of toner, by a developing apparatus 5. The method used for developing the electrostatic latent image in this embodiment is one of the jumping developing methods, which applies to a development roller 7 as a developing member, a development bias voltage from a development bias power source (unshown). The development bias voltage in this embodiment is a combination of AC and DC voltages. As the development bias voltage is applied to the development roller 7, the electrostatic latent image on the peripheral surface of the photosensitive drum 1 is developed (reversal development) by the toner (developer) which has been negatively charged by the friction between the toner, and a developer layer thickness regulating member 6 as well as the development roller 7, which occurs in the interface between the two components 6 and 7.

After the development of the electrostatic latent image on the peripheral surface of the photosensitive drum 1 into the toner image, the toner image is transferred by a transfer roller 22 onto a sheet of a recording medium P fed into the apparatus main assembly. More specifically regarding the conveyance of recording medium P, while the latent image is formed on the photosensitive drum 1, the pickup roller 61 of a sheet feeder cassette 60, and a sheet feeder roller 62, are rotationally driven with a preset control timing. As the two rollers 61 and 62 are driven, sheets of the recording medium P are fed one by one into the apparatus main assembly from the sheet feeder cassette 60, which are holding layers multiple sheets of the recording medium P. Then, each sheet of the recording medium P is delivered to a pair of registration rollers 63, by which each sheet of the recording medium P is temporarily held. Then, each sheet of the recording medium P is released by the pair of registration rollers 63, with such a timing that the leading edge of the image transfer area of the sheet of recording medium P arrives at a transfer roller 22 at the same time as the leading edge of the latent image on the peripheral surface of the photosensitive drum 1.

The transfer roller 22 is kept pressed against the photosensitive drum 1 toward the axial line of the photosensitive drum 1 by springs (unshown). As the transfer process begins at the arrival of the recording medium P, a transfer bias voltage, which is positive in polarity, is applied to the transfer roller 22 from a transfer bias power source (unshown). As a result, the toner on the peripheral surface of the photosensitive drum 1, which has been remaining negatively charged, is transferred onto the recording medium P.

After the transfer of the toner image onto the recording medium P, the recording medium P is separated from the peripheral surface of the photosensitive drum 1, and is conveyed to a fixing apparatus 23, which fixes the unfixed toner image on the recording medium P to the recording medium P with the use of heat, pressure, etc.

Also after the transfer of the toner image onto the recording medium P, the peripheral surface of the photosensitive drum 1 is cleaned by a cleaning apparatus 4 and the toner remaining on the peripheral surface of the photosensitive drum 1 is scraped away by the cleaning apparatus 4. The cleaned portion of the peripheral surface of the photosensitive drum 1 is used for the following image formation cycle. The cleaning apparatus 4 in this embodiment is provided with a cleaning member 3 made up of a blade 3*a*, and a blade supporting member 3*b* formed of metallic plate. The cleaning member 3 is for removing the transfer residual toner, that is, the toner which failed to be transferred from the photosensitive drum 1 onto the recording medium P during the transfer process. The blade 3*a* is positioned so that its cleaning edge, which extends in the lengthwise direction of the photosensitive drum 1, is kept pressed upon the peripheral surface of the photosensitive drum 1 in a manner to generate a preset amount of contact pressure against the peripheral surface of the photosensitive drum 1. The blade 3*a* cleans the peripheral surface of the photosensitive drum 1; it removes the transfer residual toner from the peripheral surface of the photosensitive drum 1. The blade 3*a* is tilted so that its cleaning edge is on the upstream side of its base in terms of the rotational direction of the photosensitive drum 1. After the completion of the cleaning process, the cleaned portion of the peripheral surface of the photosensitive drum 1 re-enters the charging process.

After passing by the transfer roller 22, the recording medium P is separated from the peripheral surface of the photosensitive drum 1, and is introduced into the fixing apparatus 23, in which the unfixed toner image on the recording medium P is fixed to the recording medium P by heat and pressure; the unfixed toner image is turned into a permanent image. Then, the recording medium P is conveyed out of the fixing apparatus 23, and is discharged as a print, by a pair of sheet discharging rollers 64, into a delivery tray 65, which is outside the apparatus main assembly.

The image forming apparatus 150 forms an image by repeating the charging, exposing, developing, transferring, fixing, and cleaning processes, with use of the above described processing means.

The process cartridge 250 is made up of the photosensitive drum 1, the charge roller 2, the cleaning apparatus 4, and a cartridge in which the preceding processing means are integrally disposed so that they can be removably mounted in the main assembly of the image forming apparatus 150, as described above.

Next, the cleaning member 3 employed by an image forming apparatus, such as the image forming apparatus 150 described above, will be described in more detail regarding its structure.

(Manufacturing of Blade)

First, the method for manufacturing the blade 3*a* in this embodiment will be described.

The blade 3*a* in this embodiment is formed of a combination of a polyisocyanate compound and a multi functional active hydrogen compound.

As the type of polyisocyanate compound as the material for the blade 3*a* in this embodiment, it is desired to use prepolymer, or semi-prepolymer, obtainable by making ordinary polyisocyanate react with macromolecule polyol, which is a multi-functional active hydrogen compound. For the purpose of obtaining a satisfactorily elastic blade 3*a*, the isocyanate radical content (NCO %) of prepolymer or semi-prepolymer is desired to be in the range of 5-20%. Incidentally, the abovementioned isocyanate radical content (NCO %) is the amount in percentage of the isocyanate radicals (NCO, molecular weight of which is assumed to be 42) in the prepolymer or semi-prepolymer, which is the material for polyurethane resin.

As examples of polyisocyanate which is ordinarily used for manufacturing the abovementioned prepolymer, semi-prepolymer, or the like, there are diphenyl-methane di-isocyanate (MDI), tolylenediisocyanate (TDI), naphthalene-diisocyanate (NDI), hexamethylene-diisocyanate (HDI), etc. As examples of macromolecule polyol which is an active hydrogen compound for manufacturing the abovementioned prepolymer, semi-prepolymer, or the like, there are polyester-polyol, polyether-polyol, caprolactone-ester-polyol, polycarbonate-ester-polyol, silicon-polyol, etc. The weight average molecular weights of these substances are desired to be in a range of 500-5,000.

As examples of the bridging agent usable for manufacturing the blade 3*a* in this embodiment, 1,4 butane-diol, 1,6 hexane-diol, ethylene-glycol, trimethylol-propane, etc.

Incidentally, sometimes, one of the ordinary catalysts, which is used to manufacture polyurethane resin is added when causing the abovementioned polyisocyanate compound to react with the macromolecular polyol, polyisocyanate, and bridging agent. As examples of such a catalyst, there are triethylene diamine, and the like.

The method for molding the blade 3*a* of polyurethane resin is as follows: macromolecular polyol, polyisocyanate, a bridging agent, a catalyst, etc., are mixed together, and the mixture is poured into a metallic mold. The blade 3*a* is formed of the polyurethane resin so that the blade 3*a* is directly molded onto the supporting member 3*b*. Further, for the purpose of improving the cleaning edge of the blade 3*a*, that is, the portion of the blade 3*a* which comes into contact with the peripheral surface of the photosensitive drum 1, the cleaning edge portion of the blade 3*a* is trimmed after the molding of the blade 3*a*.

(Blade Treatment)

Next, the method for treating the precursor of the blade 3*a*, which is formed of polyurethane resin with the use of the above described method, will be described.

The precursor of the blade 3*a*, which was formed of polyurethane through the above described steps, is treated to yield the blade 3*a*, that is, a cleaning blade having treated lengthwise end portions. An example of the method for treating a precursor of the blade 3*a* formed of polyurethane as described above, to yield the blade 3*a* having the abovementioned treated portions is as follows:

Step (1): an isocyanate compound is placed in contact with the cleaning edge of the blade 3*a*, that is, the portion of the blade 3*a* which is placed in contact with the peripheral surface of the photosensitive drum 1, across the lengthwise portions;

Step (2): the isocyanate compound is kept in contact with the surface of the blade 3*a* to allow the blade 3*a* to be impregnated (treated) with the isocyanate compound;

Step (3): the isocyanate compound remaining on the surface of the blade 3*a* is removed after the completion of Step (2); and Step (4): the polyurethane, of which the blade 3*a* is composed, is allowed to react with the isocyanate compound in the blade 3*a*, to form allophanate bonds so that the blade 3*a* having hardened lengthwise end portions (treated portions 3*a*1 and 3*a*2) is produced; the lengthwise end portions of the cleaning edge of the blade 3*a* ae treated to harden them.

That is, in Steps (1) and (2), the lengthwise end portions of the cleaning edge of the blade 3*a* formed of polyurethane resin are impregnated (treated) with a proper amount of isocyanate compound. In Step (3), the excess amount of isocyanate compound is removed from the surface of the blade 3*a*, and in Step (4), the isocyanate in the blade 3*a* is allowed to react with the polyurethane of which the blade 3*a* is formed, to harden the lengthwise end portions of the cleaning edge of the blade 3*a*, that is, to yield the blade 3*a* having the treated portions (hard portions).

It is thought that in Step (4), the polyurethane resin in the blade 3*a* reacts with the isocyanate compound in the blade 3*a*, forming allophanate bonds, which harden the lengthwise end portions (3*a*1, 3*a*2) of the cleaning edge portion of the blade 3*a*, thereby yielding the blade 3*a* having the treated portions 3*a*1 and 3*a*2. The finished blade 3*a* has the treated portion 3*a*1, which extends across one of the lengthwise end portions of the blade 3*a*, and the treated portion and 3*a*2, which extends across the other lengthwise end portions.

To elaborate, the urethane resin in the blade 3*a* contains urethane bonds which have active hydrogen. Thus, allophanate bonds are formed through the reaction between the urethane bonds, of which the blade 3*a* is formed, and the isocyanate compound with which the blade 3*a* was impregnated (treated). As a result, the lengthwise end portions 3*a*1 and 3*a*2 harden in Step (4). Also in Step (4), the isocyanate compound polymerizes (yielding carbodiimide, isocyanurate, etc.) at the same time, contributing to the hardening of the lengthwise end portions of the cleaning edge of the blade 3*a*. It is reasonable to think that, as a result, the lengthwise end portions of the cleaning edge of the blade 3*a* increases in hardness, and therefore, reduces in coefficient of friction, thereby improving the durability of the blade 3*a*.

As the type of isocyanate compound with which the blade 3*a* is to be impregnated, an isocyanate compound having a single isocyanate radical per molecule, and an isocyanate compound having two or more isocyanate radicals per molecule, can be used. As examples of an isocyanate compound having a single isocyanate radical, aliphatic monoisocyanate such as octadecyl isocyanate (ODI), aromatic monoisocyanate, and the like, can be listed.

As for the type of isocyanate compound with which the abovementioned blade 3*a* is to be impregnated, and which has two isocyanate radicals per molecule, there are 2,4-tolylenediisocyanate, 2,6-tolylenediisocyanate, 4,4'-diphenyl-methane-diisocyanate (MDI), -phenyl-diisocyanate, tetramethyl-diisocyanate, hexamethylene-diisocyanate, etc.

In this embodiment, for the purpose of enhancing the reaction of the isocyanate compound with the polyurethane, the precursor of the blade 3*a* formed of polyurethane may be impregnated with a catalyst, in addition to the isocyanate compound.

As examples of the catalyst usable with the isocyanate compound, there are quaternary ammonium salt, carboxylate, salt, etc. As examples of the quaternary ammonium salt, there is a TMR catalyst (product of DABCO Co., Ltd.) or the like. As examples of carboxylate, there are potassium acetate, potassium octylate, etc. These catalysts are very viscous, or solid. Therefore, it is desired that they are dissolved in advance in a solvent before they are added to the isocyanate compound before the precursor of the blade 3*a* is placed in contact with the isocyanate compound.

As for the method for impregnating the precursor of the blade 3*a* with the isocyanate compound, the isocyanate compound may be coated on the blade 3*a* with a fibrous or porous member soaked with the isocyanate compound, or may be sprayed on the blade 3*a*.

After the coating of the blade 3*a* with the isocyanate compound, the isocyanate compound is left on the blade 3*a* for a preset length of time to allow the isocyanate compound to permeate the blade 3*a*. For the purpose of ensuring that the preset portions of the precursor of blade 3*a* are impregnated with the isocyanate compound, the length of time the isocyanate compound is kept in contact with the precursor of blade 3*a* is desired to be no less than five minutes, preferably, no less than ten minutes. Further, it is desired to be no more than one hour. In consideration of the mass production of the blade 3*a*, it is preferred to be no more than 40 minutes.

Then, in Step (3), the isocyanate compound remaining on the surface of the precursor of blade 3*a* is wiped away with the use of a solvent capable of dissolving the isocyanate compound. If the isocyanate compound remains on the precursor of blade 3*a* (in a large amount sometimes) after Step (2), that is, the step in which the precursor of blade 3*a* is impregnated with the isocyanate compound, so that the isocyanate compound is incompletely removed, the surface of the portions of the precursor of blade 3*a* impregnated with isocyanate compound remains uneven. This process produces a blade (3*a*) whose cleaning edge has minute protrusions across the portions impregnated with the isocyanate compound. Such a blade (3*a*) will fail to satisfactorily clean the peripheral surface of the photosensitive drum 1; if such a blade (3*a*) is employed, toner will slip by a blade 3*a*, through the areas around the minute protrusions.

This is why Step (3), that is, the step in which the isocyanate compound having adhered to the surface of the blade 3*a* is completely removed with the use of a solvent capable of dissolving the isocyanate compound, is necessary. As examples of the solvent usable for this step, there are toluene, xylene, butyl acetate, methyl ethyl ketone, or the like.

As for the means for removing the isocyanate compound, it is possible to wipe away the excessive amount of the isocyanate compound, that is, the isocyanate compound remaining adhered to the surface of the blade 3*a*, with the use of a piece of sponge which is not hard enough to damage the blade 3*a*, that is, a blade formed of polyurethane, and is soaked with a small amount of the abovementioned solvent.

Figure 3:
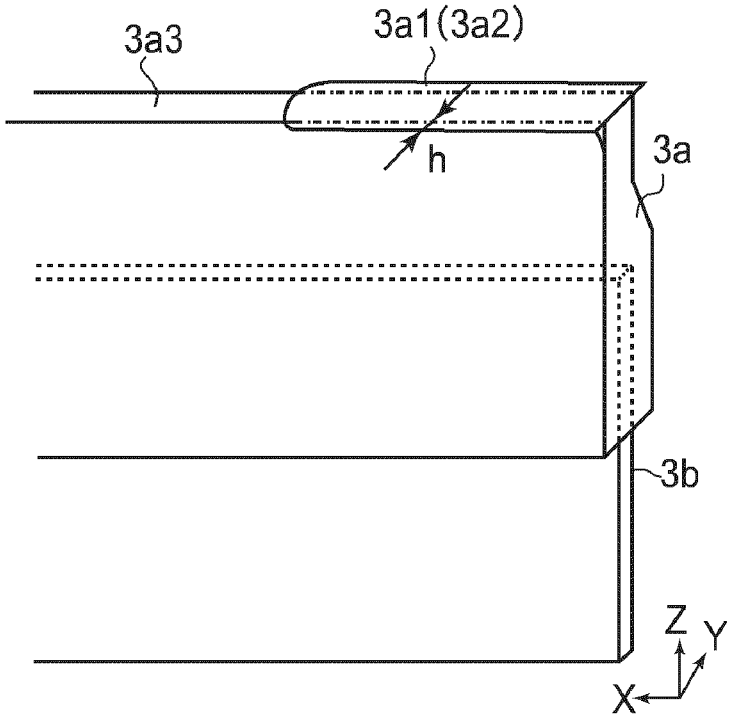
FIG. 3 is a schematic perspective view of one of the end portions of the cleaning blade in accordance with the present invention.

After the completion of the steps described above, the isocyanate compound having permeated into the precursor of blade 3*a* reacts with urethane resin, that is, the material with which the precursor of blade 3*a* is formed, in Step (4), forming allophanate, or the isocyanate compound reacts with the moisture in the ambient air, making the portions of the blade 3*a* impregnated with isocyanate compound very hard, and also, making them appear pale white. As a result, the precursory blade 3*a* turns into the blade 3*a* which is smooth across the entirety of its cleaning edge. Referring to FIG. 3, as the isocyanate compound is allowed to permeate the lengthwise end portions of the precursory blade 3*a*, the lengthwise end portions of the precursory blade 3*a* swell in the thickness direction of the precursor of the blade 3*a*, which is indicated by an arrow mark Y. Next, this swelling of the precursor of the blade 3*a* in the direction indicated by the arrow mark Y will be described with reference to FIGS. 4 and 5.

Figure 4:
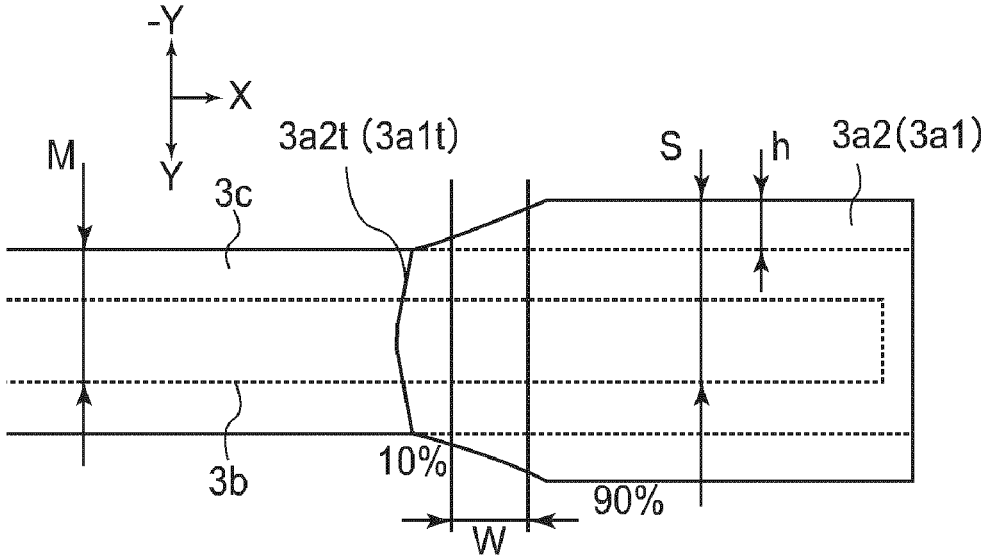
FIG. 4 is a schematic plan view of one of the end portions of the cleaning blade in accordance with the present invention, as seen from the cleaning edge side.
Figure 5:
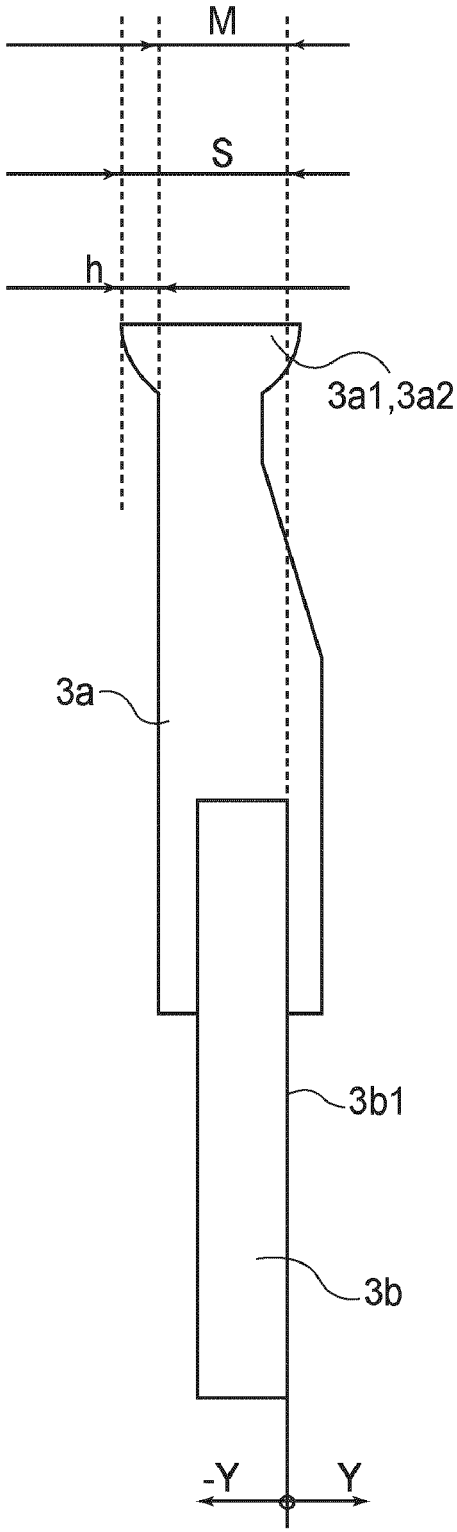
FIG. 5 is a schematic drawing of the cleaning blade in accordance with the present invention, as seen from the direction parallel to the lengthwise direction of the blade.

FIG. 4 is a schematic drawing of the blade 3*a*, as seen from directly above the blade 3*a*. FIG. 5 is a schematic drawing of the blade 3*a*, as seen from the direction coinciding with the lengthwise direction of the blade 3*a*. As the isocyanate compound permeates the precursor of the blade 3*a* formed of polyurethane resin, the portions of the precursor of the blade 3*a*, into which the isocyanate compound is permeating, swell in the thickness direction of the precursor of the blade 3*a*, that is, the direction indicated by the arrow mark Y. The amount h (width) by which the lengthwise end portions of the precursor of the blade 3*a* have swollen due to the permeation of the isocyanate compound into the lengthwise end portions of the precursor of the blade 3*a* can be obtained as the amount of difference between a distance S, which is the distance from one end 9*a* of the supporting member 3*b* to the treated portion 3*a*1 or 3*a*2 of the blade 3*a* in terms of the thickness direction of the supporting member 3*b*, that is, the direction indicated by the arrow mark Y, and a distance M, which is the distance from one end 3*b*1 to the untreated portion 3*a*3 of the blade 3*a*.

Figure 6:
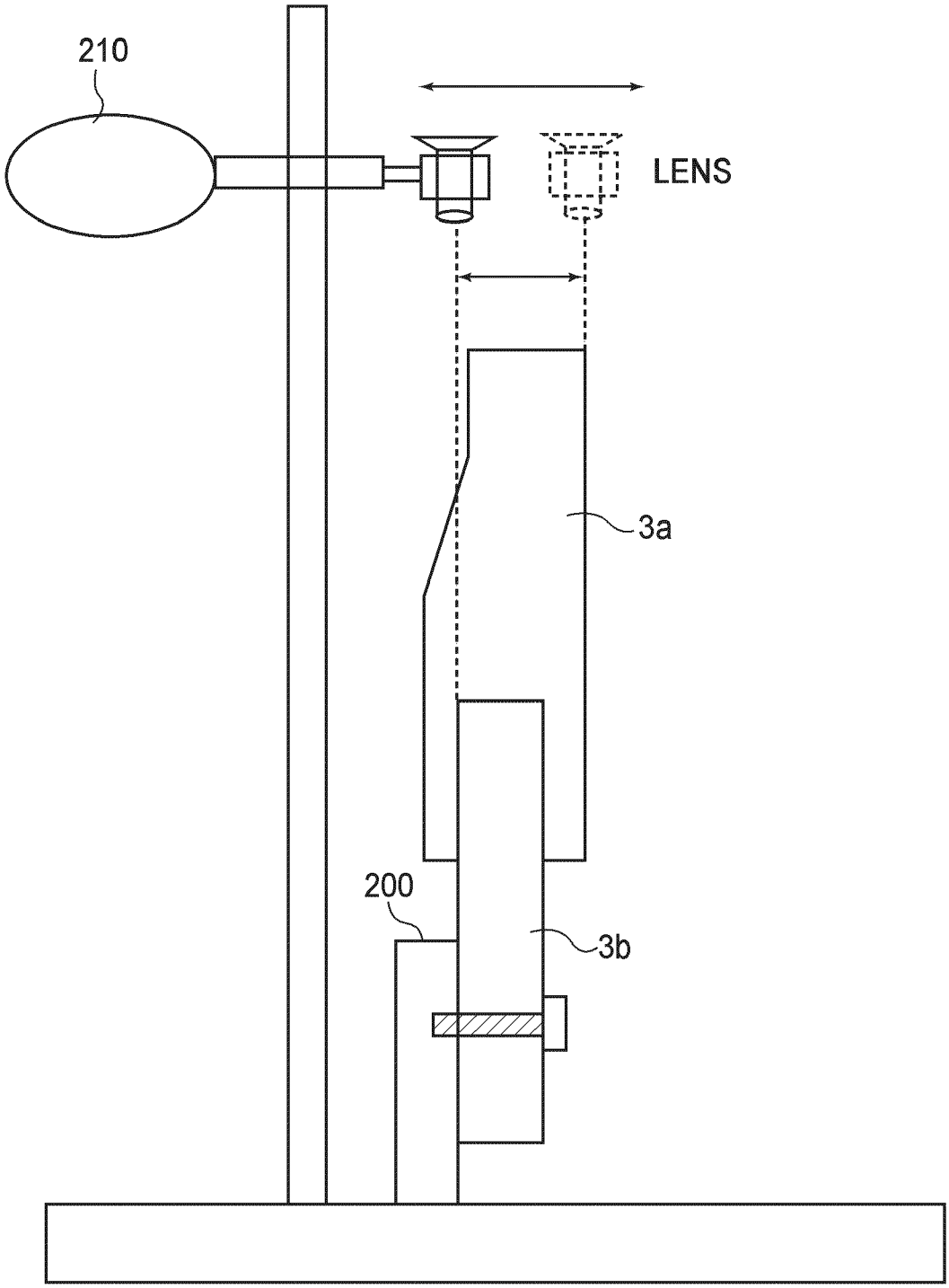
FIG. 6 is a schematic drawing of an apparatus for measuring the amount of the swelling of the cleaning blade in the thickness direction of the blade.

In order to ensure that the measured amount h (width) of swelling is as accurate as possible, the thickness of the precursor of the blade 3*a* was measured at three points of the blade, in terms of the lengthwise direction of the blade, that is, at the center, and two points which are 1 mm away from the center in the opposite directions, and the average value of the results of the three measurements was used as the value for the distance M. As for the distance S, the largest width of the treated portion 3*a*1 or 3*a*2 was used. FIG. 6 shows the actual method for measuring the amount h (width) of swelling of the precursor of the blade 3*a*. Before the supporting member 3*b* is attached to the blade supporting member supporting portion 200, the location of the edge of the blade supporting member supporting portion 200 was detected with the use of a micrometer 210. Then, the blade supporting member 3*b* was attached to the blade supporting member supporting portions 200. Then, the distances S and M were measured.

As the isocyanate compound permeates the lengthwise end portions of the precursor of the blade 3*a*, the inward end portion 3*a*1*t* (3*a*2*t*) of the lengthwise end portion of the precursor of the blade 3*a*, in terms of the lengthwise direction of the blade, that is, the inward end portion of the blade 3*a*, which the isocyanate compound permeated, becomes as shown in FIG. 4. That is, as the isocyanate compound permeates the lengthwise end portions of the precursor of the blade 3*a*, a portion, the width of which, in terms of the thickness direction of the blade, gradually is reduced from the outward end toward the inward end, emerges between the portion that the isocyanate compound is permeating and the portion that the isocyanate compound is not permeating. Hereafter, the portion of this portion of the precursor of the blade 3*a*, the width of which gradually is reduced from 90% to 10% of the amount h (width) of swelling, will be referred to as the transitional portion.

(Positional Relationship Between Treated Portions of Cleaning Blade and Functional Ranges of Processing Means)

Figure 1:
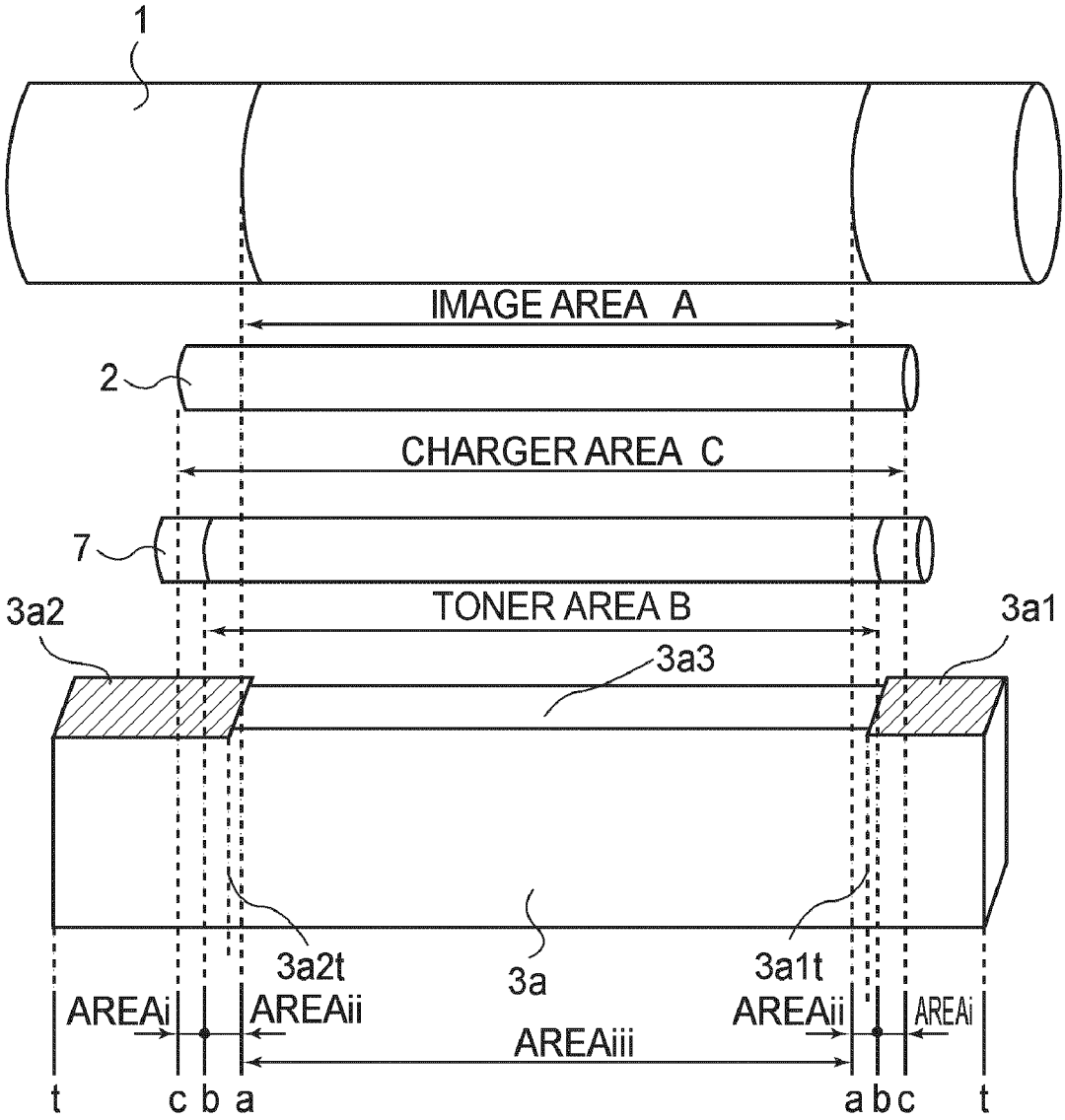
FIG. 1 is a schematic drawing of the structural components of a process cartridge, showing the positional relationship among the components of the process cartridge in terms of the lengthwise direction of the process cartridge.

Next, the position of the lengthwise end portions of the blade 3*a*, that is, the portions of the blade 3*a* impregnated with the isocyanate compound, will be described. FIG. 1 shows the position of the portion of the blade 3*a* impregnated with the isocyanate compound (which hereafter may be referred to as the treated portion), relative to the other structural components of the cleaning apparatus 4. Designated by reference letter A is the image formation range, in terms of the lengthwise direction of the photosensitive drum 1, in which an image can be formed on the peripheral surface of the photosensitive drum 1. Designated by reference letter B is the developer bearing range (which hereafter will be referred to as toner coat range), in terms of the lengthwise direction of the development roller 7, in which developer (toner) can be borne on the peripheral surface of the development roller 7 to develop a latent image on the peripheral surface of the photosensitive drum 1. Designated by reference letter C is the charging range, in terms of the lengthwise direction of the charge roller 2, in which the peripheral surface of the photosensitive drum 1 can be charged. The changing range was made wider than the toner coat range B, in order to prevent toner from adhering to the peripheral surface of the photosensitive drum 1. In spite of the above described structural arrangement, however, it is possible that toner will adhere to the portions of the peripheral surface of the photosensitive drum 1 that are outside the charging range C, which is wider than the development range B. Thus, the blade 3*a* was made long enough for the blade 3*a* to contact even the portions of the peripheral surface of the photosensitive drum 1 that are outside the charging range C. Further, both of the lengthwise end portions (3*a*1 and 3*a*2) of the blade 3*a* are impregnated (treated) with the isocyanate compound. Also referring to FIG. 1, designated by reference letters a, b, c, and t are the ends of the image formation range A, the toner coat range B, the charging range C, and the blade 3*a*, respectively.

Incidentally, there is a possibility that the blade 3*a* will buckle due to the friction between the untreated portion of the cleaning edge of the blade 3*a* and the peripheral surface of the photosensitive drum 1 immediately after the cleaning blade 3*a* is put to use for the first time, because the friction between the untreated portion of the cleaning edge of the blade 3*a* and the peripheral surface of the photosensitive drum 1 is substantially greater when the cleaning blade 3*a* is brand new than after it is used for a certain length of time. In order to prevent the occurrence of this problem, the blade 3*a* is coated in advance with lubricant across its entire range in terms of its lengthwise direction. The lubricant is fluorinated graphite (Fusebon: product of Central Glass Co., Ltd.), which is 3 μm in average particle diameter. It is dispersed in hydrofluoroether (HFE) as a solvent by 10% in weight ratio, and the mixture is coated on the blade 3*a* and dried.

(Evaluation of Cleaning Blade)

The blade 3*a* was evaluated with the use of a laser beam printer LaserJet 4300J (product of Hewlett Packard Co., Ltd.). The blade 3*a* was evaluated in a relatively severe environment. That is, regarding the buckling of the blade 3*a*, the cleaning blade 3*a* was evaluated in an environment in which temperature was 32.5° C. (relatively high), and the humidity was 80% (relatively high). As for the cleaning performance, the blade 3*a* was evaluated in an environment in which temperature was 15° C. (relatively low), and humidity was 10% (relatively low). The summary of the results of the evaluations of the blade 3*a* in the preferred embodiments, and the blade 3*a* in comparative embodiments, are given in Table 1.

Embodiment 1

The blade 3*a* in the first embodiment was formed of polyurethane, and its lengthwise end portions, in terms of its lengthwise direction, were impregnated (treated) with a proper amount of the isocyanate compound in Step (1) described above; the portions 3*a*1 of the blade 3*a* that extend from one of the lengthwise ends t of the blade 3*a*, to a preset point in the range (range ii) between the corresponding end b of the toner coat range B and the corresponding end a of the image formation range A, and the portion 3*a*2 of the blade 3*a* that extends from the other lengthwise end t of the blade 3*a*, to a preset point in the range (range ii) between the corresponding end b of the toner coat range B and the corresponding end a of the image formation range A, are impregnated with a proper amount of the isocyanate compound. Then, in Step (2), the isocyanate compound on the aforementioned portions of the blade 3*a* were left there for 20 minutes to allow the blade 3*a* to swell 30 μm (amount h) in the thickness direction. The resultant transitional portions W were roughly 1 mm in terms of the lengthwise direction of the blade 3*a*, and fell within the range ii.

The blade 3*a* formed through the above described steps was evaluated. The blade 3*a* did not buckle, and its cleaning performance remained satisfactory, even after the printing of 20,000 copies.

Comparative Embodiment 1

The cleaning blade 3*a* in the first comparative embodiment was different from the cleaning blade 3*a* in the preferred embodiment of the present invention in that its treated portion 3a1 (3a2) extending from the end t of the blade 3a, to a preset point in the range (range i) between the end c of the charging range C and the end b of the toner coat range B. Otherwise, the cleaning blade 3a in this comparative embodiment is the same as the cleaning blade 3a in the preferred embodiment.

The blade 3a in the first comparative embodiment was evaluated in the same environment as that in which the cleaning blade 3a in the preferred embodiment was evaluated. Its cleaning performance remained satisfactory even after the printing of 20,000 copies. However, the blade in this comparative embodiment buckled after the printing of 3,000 copies.

The evaluation of the blade 3a in this comparative embodiment proves that in order to prevent a cleaning blade 3a from buckling, the lengthwise end portions of the blade 3a must be impregnated (treated) with the isocyanate compound in such a manner that the inward ends 3a1*t* and 3a2*t* of the treated portions 3a1 and 3a2, respectively, will fall in the corresponding ranges (ii) between the ends a and b.

Comparative Embodiment 2

The cleaning blade 3a in the second comparative embodiment was different from the cleaning blade 3a in the preferred embodiment of the present invention in that its lengthwise end portions were allowed to swell by 40 μm (amount h). Otherwise, the blade 3a in the second comparative embodiment is the same as the cleaning blade 3a in the preferred embodiment. In order to allow the lengthwise end portions of the blade 3a in the second comparative embodiment to swell 40 μM, isocyanate compound was left on the blade 3a for 30 minutes after it was placed in contact with the blade 3a.

The blade 3a manufactured through the steps described above was evaluated. The blade 3a did not buckle even after the printing of 20,000 copies. However, after the printing of 20,000 copies, toner began to slip by the blade 3a, in the immediate adjacencies of the inward ends 3a1*t* and 3a2*t* of the treated portions 3a1 and 3a2, respectively, of the blade 3a, the blade 3a began to unsatisfactorily clean the peripheral surface of the photosensitive drum 1.

The results of this evaluation prove that if the amount h (width) by which the lengthwise end portions of the blade 3a is allowed to swell is relatively large (40 μm), toner slips by the blade 3a, in the immediate adjacencies of the inward ends 3a1*t* and 3a2*t* of the treated portions 3a1 and 3a2, respectively, of the blade 3a; the blade 3a fails to satisfactorily clean the peripheral surface of the photosensitive drum 1, allowing thereby the formation of an unsatisfactory image.

Based on the results of the evaluations described above, it is reasonable to say that the blade 3a can be prevented from buckling, by impregnating the lengthwise end portions of the precursor of the blade 3a with isocyanate compound to yield the blade 3a whose portions impregnated with isocyanate compound will extend from the lengthwise end t of the blade 3a to a preset point of the blade 3a, which is within the toner coat range. Further, based on the results of the evaluation of the blade 3a in the first comparative embodiment, it is reasonable to say that if the inward ends 3a1*t* and 3a2*t* of the treated portions 3a1 and 3a2, respectively, are outside the toner coat range B, the blade 3a is likely to buckle.

Further, as the isocyanate compound is allowed to permeate the lengthwise ends of the blade 3a, the lengthwise end portions of the blade 3a swell, and therefore, the lengthwise end portions, that is, the treated portions, of blade 3a become different in dimension from the rest, that is, the untreated potion, of the blade 3a. As long as the amount h (width) by which the lengthwise end portions of the blade 3a swell is no more than 30 μm, the image forming apparatus does not form an unsatisfactory image whose defects are attributable to unsatisfactory cleaning of the peripheral surface of the photosensitive drum 1 by the cleaning blade 3a, and the blade 3a does not buckle. This can be said based on the fact that the blade 3a, in the second comparative embodiment, whose lengthwise end portions were allowed to swell 40 μm allowed toner to slip by the blade 3a, failing therefore to satisfactorily clean the peripheral surface of the photosensitive drum 1.

Embodiment 2

In this embodiment, the lengthwise end portions of the precursor of the blade 3a were impregnated (treated) with a proper amount of isocyanate compound to yield the blade 3a having the treated portions 3a1 and 3a2, each of which extends from the corresponding end t of the blade 3a to a preset point of the blade 3a, which is on the inward side of the image formation range A (more specifically, in the range iii). Otherwise, this embodiment is the same as the first embodiment.

When the blade 3a in this embodiment was tested, the blade 3a did not buckle even after the printing of 20,000 copies. However, after the printing of 10,000 copies in an environment which is low in temperature as well as humidity, the image forming apparatus began to form an image whose halftone areas suffered from slight vertical streaks. This seems to have occurred for the following reason. That is, the external additives, which were smaller in particle diameter than toner, slipped by the blade 3a, in the immediate adjacencies of the inward ends 3a1*t* and 3a2*t* of the treated portions 3a1 and 3a2, respectively, of the blade 3a, and then, contaminated the charge roller 2. The contaminated portions of the charge roller 2 failed to satisfactorily charge the photosensitive drum 1. Although the presence of the slight streaks in an image is not a serious problem in practical terms, it is still preferred that the inward ends 3a1*t* and 3a2*t* of the treated portions 3a1 and 3a2, respectively, fall within the corresponding toner coat ranges B, and outside the image formation range A.

Embodiment 3

In the third embodiment, the amount h (width) by which the lengthwise end portions of the blade 3a were allowed to swell was set to 10 μm. Otherwise, this embodiment is the same as the first embodiment. In order to allow the lengthwise end portions of the blade 3a in this embodiment to swell 10 μm, the isocyanate compound was left on the blade 3a for 10 minutes in Step (2) after it was placed in contact with the blade 3a.

The blade 3a manufactured through the steps described above was evaluated. Even after the printing of 20,000 copies, not only did the blade 3a not buckle, but also, it remained satisfactory in terms of cleaning performance.

Embodiment 4

The fourth embodiment is different from the first embodiment in that the amount h (width) by which the lengthwise end portions of the blade 3a in the fourth embodiment were allowed to swell was set to 5 μm. Otherwise, the fourth embodiment is the same as the first embodiment. In this embodiment, therefore, in order to allow the lengthwise end portions of the blade 3a to swell 5 μm, the isocyanate compound was left on the blade 3*a* for 5 minutes in Step (2) after it was placed in contact with the blade 3*a*.

The results of the tests carried out to evaluate the blade 3*a* in this embodiment revealed that even after the printing of 20,000 copies, the blade 3*a* did not buckle, and remained satisfactory in terms of cleaning performance. However, noises (vibratory sound) occurred during the printing operation, which were attributable to the rubbing between the blade 3*a* and photosensitive drum 1.

It practical terms, these noises do not create serious problems. However, it is reasonable to say that the amount h (width) by which the lengthwise end portions of the blade 3*a* are allowed to swell is preferred to be no less than 10 μm and no more than 30 μm.

As described above, the present invention makes it possible to prevent the blade of a cleaning member from buckling by the movement of an image bearing member, while keeping the cleaning member satisfactory in cleaning performance.

TABLE 1

| | Position of inward ends 3alt and 3a2t of treated portions *3 | Amount h of swelling | Blade buckling | Cleaning performance |
|---|---|---|---|---|
| Emb. 1 | ii | 30 μm | Good | Good |
| Comp. Emb. 1 | i | 30 μm | Bad | Good |
| Comp. Emb. 2 | ii | 40 μm | Good | Bad |
| Emb. 2 | iii | 30 μm | Good | *1 Fair |
| Emb. 3 | ii | 10 μm | Good | Good |
| Emb. 4 | ii | 5 μm | *2 Fair | Good |

*1: presence of slight vertical streaks across image
*2: occurrence of vibratory noises
*3: position of inward edges of treated portions
i: between toner coat range B and charging range C
ii: between toner coat range B and image formation range A
iii: within image formation range A.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 208738/2007 filed Aug. 10, 2007, which is hereby incorporated by reference.

What is claimed is:

1. A process cartridge detachably mountable to an image forming apparatus, said process cartridge comprising:

an image bearing member;

a developing member configured and positioned to develop an electrostatic latent image formed on a surface of said image bearing member; and a cleaning member having a blade contacting said image bearing member along a longitudinal direction of said image bearing member to remove the developer from the surface of said image bearing member, said cleaning member having a processed portion containing an isocyanate compound at each of longitudinal end portions of said blade, wherein a longitudinally inside end of said processed portion is disposed longitudinally inside a developer carryable region of said developing member which is capable of carrying the developer, wherein a step portion of not more than 30 μm is provided between said processed portion and a non-processed portion with respect to a widthwise direction of said blade.

2. A process cartridge according to claim 1, wherein the inside end of said processed portion is disposed longitudinally outside an image forming region where the image can be formed on the recording material.

3. A process cartridge according to claim 1, wherein a step portion of not less than 10 μm and not more than 30 μm is provided between a maximum of said processed portion and a non-processed portion with respect to a widthwise direction of said blade.

4. An image forming apparatus for forming an image on a recording material, said image forming apparatus comprising:

an image bearing member;

a developing member configured and positioned to develop an electrostatic latent image formed on a surface of said image bearing member; and a cleaning member having a blade contacting said image bearing member along a longitudinal direction of said image bearing member to remove the developer from the surface of said image bearing member, said cleaning member having a processed portion containing an isocyanate compound at each of longitudinal end portions of said blade, wherein a longitudinally inside end of said processed portion is disposed longitudinally inside a developer carryable region of said developing member which is capable of carrying the developer, wherein a step portion of not more than 30 μm is provided between said processed portion and a non-processed portion with respect to a widthwise direction of said blade.

5. An apparatus according to claim 4, wherein the inside end of said processed portion is disposed longitudinally outside an image forming region where the image can be formed on the recording material.

6. An apparatus according to claim 4, wherein a step portion of not less than 10 μm and not more than 30 μm is provided between a maximum of said processed portion and a non-processed portion with respect to a widthwise direction of said blade.

* * * * *